US005273786A

United States Patent [19]

Brown

[11] Patent Number: 5,273,786

[45] Date of Patent: Dec. 28, 1993

[54] METHOD FOR IMPREGNATING TIMBER WITH A LIQUID AND INJECTOR THEREFOR

[75] Inventor: Michael E. Brown, Callander, United Kingdom

[73] Assignee: Unicorn Fluid Injectors, Ltd., Callander, United Kingdom

[21] Appl. No.: 768,865

[22] Filed: Nov. 15, 1991

[30] Foreign Application Priority Data

Mar. 28, 1989 [GB] United Kingdom ..... 8906926
Aug. 12, 1989 [GB] United Kingdom ..... 8918451

[51] Int. Cl.[5] ..... B27K 3/10; F15B 1/047

[52] U.S. Cl. ..... 427/325; 427/393; 427/440; 239/323; 239/330; 222/386.5; 222/396

[58] Field of Search ..... 427/393, 325, 440; 239/323, 330; 92/98 R, 98 D; 222/386.5, 396

[56] References Cited

U.S. PATENT DOCUMENTS 3,368,586 2/1968 French et al. ..... 92/98 R

*Primary Examiner*—Shrive Beck
*Assistant Examiner*—Katherine A. Bareford
*Attorney, Agent, or Firm*—Mason, Fenwick & Lawrence

[57] ABSTRACT

This invention relates to an all gas-loadable liquid injector. The gas-loadable liquid injector comprises an accumulator for containing a liquid and a propellant gas, a liquid delivery tube for insertion into a material to be treated by the liquid, and intermediate means between the liquid delivery tube and the accumulator. The intermediate means restricts the flow of liquid when the pressure in the accumulator substantially exceeds that in the delivery tube and allows a restricted flow of liquid when the pressure in the accumulator is substantially equal to or less than that in the delivery tube. The intermediate means has a flexible and collapsible tube extending into the accumulator from the bowels of the accumulator and a straight rigid tube having a free end. The free end of the rigid tube always lies at the lowest level in the accumulator regardless of the altitude of the injector so as to dip into any liquid in the accumulator.

5 Claims, 3 Drawing Sheets

METHOD FOR IMPREGNATING TIMBER WITH A LIQUID AND INJECTOR THEREFOR

Related Application

This application is a continuation of PCT/GB90/0457 filed Mar. 27, 1990.

BACKGROUND OF THE INVENTION

This invention relates to a liquid injector and particularly to an injector for impregnating timber with a liquid wood preservative, or brick with a damp-proofing liquid, the injector being an easily portable unit which can be either taken to its site of use in a self-powered condition ready for use or can be easily put into such condition on site.

SUMMARY OF THE INVENTION

Gas-loadable injectors are known from CH, A, 272 644 and DE, B, 121 4861 comprising an accumulator for containing a liquid and a propellant gas, and a liquid delivery tube for insertion into a material to be treated by the liquid.

The invention is characterised by intermediate means between the liquid delivery tube and the accumulator for restricting flow of liquid when the pressure in the accumulator substantially exceeds that in the delivery tube and for allowing unrestricted flow of liquid when the pressure in the accumulator is substantially equal to or less than that in the delivery tube.

Because of this, the injector can be re-charged with liquid through the delivery tube. This enables the injector to be used successfully in a method of continued impregnation of a body comprising initially setting up a jig on the body, with the use of the jig boring two intersecting holes into the body, the first hole opening into the body at a position intended to become inaccessible and the second hole opening into the body at a more accessible position, removing the jig, installing an injector such as described above by inserting the liquid delivery tube into the first hole, closing-off the second hole, beginning the injection of liquid into the body, burying or otherwise rendering the injector inaccessible, after a predetermined period opening the second hole, introducing fresh liquid under pressure into the second hole from outside so as to back-fill and repressurise the accumulator and closing-off the second hole so that continued impregnation can take place from the injector.

BRIEF DESCRIPTION OF THE DRAWINGS

Embodiments of the invention will now be described, by way of example, with reference to the accompanying schematic drawings in which.

DESCRIPTION OF THE PREFERRED EMBODIMENTS

Figure 1:
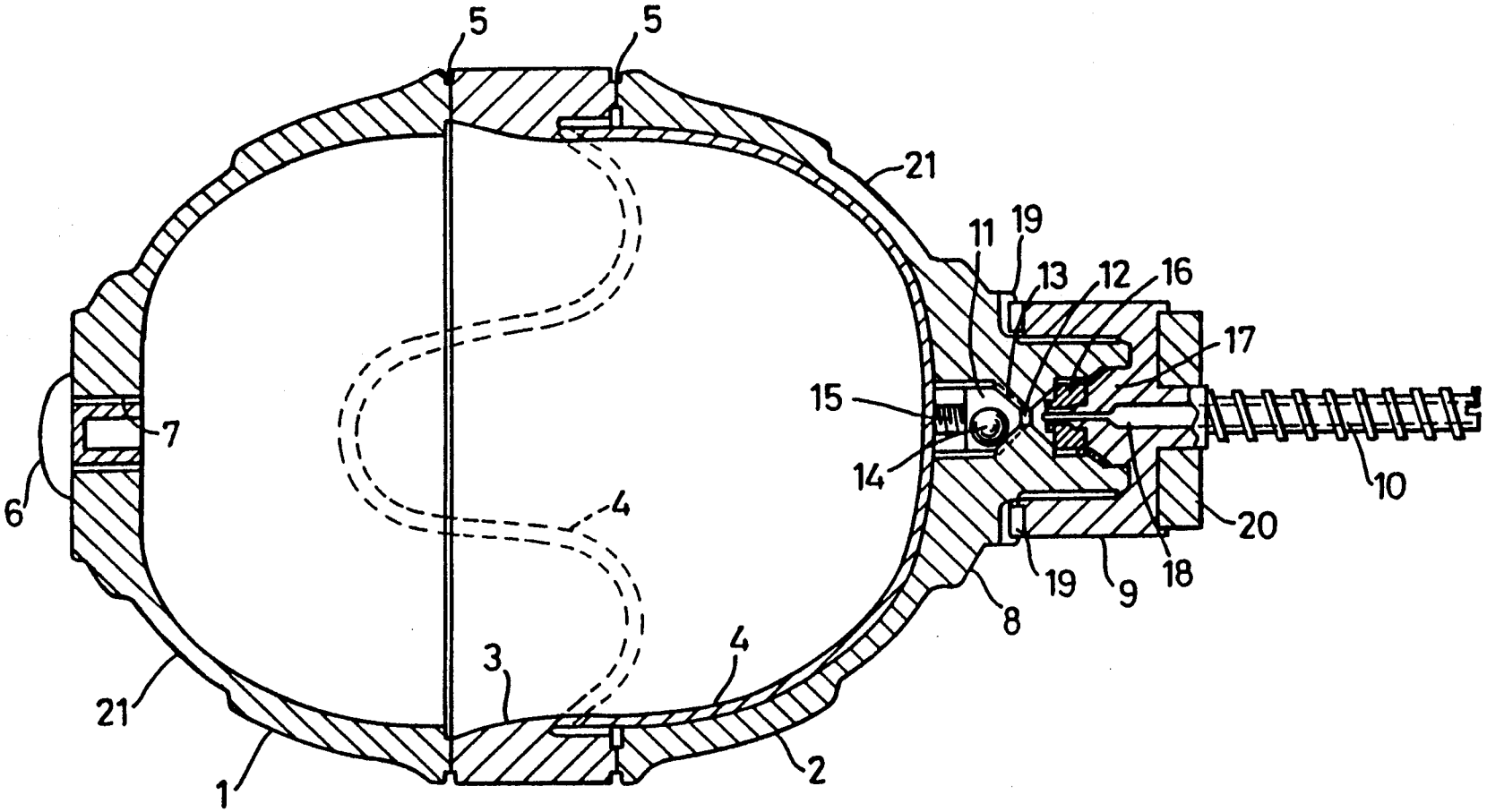
FIG. 1 is a sectional view of one form of injector according to the invention.

In FIG. 1 a gas-loadable injector comprises an accumulator formed of a first plastics shell 1, a second plastics shell 2, and a plastics membrane and ring member comprising a membrane 4 and a ring 3. The ring 3 is hot-plate welded at 5 to the shells 1 and 2. A plastics pressure seal 6 is screwed into an opening 7 in the shell 1 remote from the welded ring. Also remote from the welded ring the shell 2 has an integral boss 8 onto which is screwed a cap and delivery tube member comprising a cap 9 and a delivery tube 10 having a coarse external screw thread.

Within the boss 8 there is a chamber 11 which flares from one side of a throat 12 with fine grooves 13 in the flare. A ball 14 is retained in the chamber 11 by means of a cruciform piece 15 screwed into the chamber 11 from the interior of the shell 2. A frangible seal 16 is screwed into another chamber in the boss 8 on the other side of the throat 12 and between the throat 12 and a nose portion 17 of the cap 9, which portion 17 has a through-bore 18 communicating with the delivery tube 10. On the rim of the cap 9 and a shoulder on the boss 8 there are co-operating ratchet teeth 19 which permit the cap 9 to be screwed on the boss 8 but prevent unscrewing of the cap 9 from the boss 8. The unstressed shape of the membrane 4 is shown in full lines.

The injector is charged in the following manner. The seals 6 and 16 and the cap 9 and delivery tube 10 are removed. This enables the interior of the two shells 1 and 2, with the membrane 4 in its full line position, to be at atmospheric pressure initially. The seal 6 is screwed back into place and the liquid is forced into the shell 2 under pressure until the membrane is distended into a position as shown in broken lines. As the supply of liquid to the shell 2 is disconnected the pressure in the shells 1 and 2 forces the ball 14 to seal against the throat 12. There will be very little seepage of liquid through the grooves 13 until a replacement seal 16 is screwed into place. A frangible plastics washer with a ring pull (not shown) is placed about the boss 8 and on the shoulder having the teeth 19. The cap 9 is then screwed onto the boss 8 and into contact with its teeth 19 on the frangible washer. In this condition the nose 17 has not pierced the seal 16.

When the charged injector is to be used, it is turned as a whole, while screwing the tube 10 into a pre-bored hole in a timber to be treated until a sealing pad 20 about the tube 10 is hard against the timber. Then the frangible washer is broken and pulled clear so that the cap 9 can be screwed home on the boss 8. In so doing, the nose 17 pierces the seal 16 and causes the ball 14 to seat on the throat 12 whereupon liquid is fed through the grooves 13 at a controlled rate and into the timber. While the pressure in the shell 2 is substantially greater than in the tube 10 the ball 14 remains seated on the throat 12 so that outward flow of liquid is restricted. When the pressure in the shell 2 is substantially equal to or less than the pressure in the tube 10 on the ball 14 leaves the throat 12 so as to allow unrestricted flow through the throat 12. Because of this the injector can be re-charged with liquid through the tube 10. It will be noted that the walls of the shells 1 and 2 are thinned at 21 so as to be more translucent than the remainder of the walls. This enables the positions of the membrane 4 to be observed, particularly if it has a contrasting colour.

Figure 2:
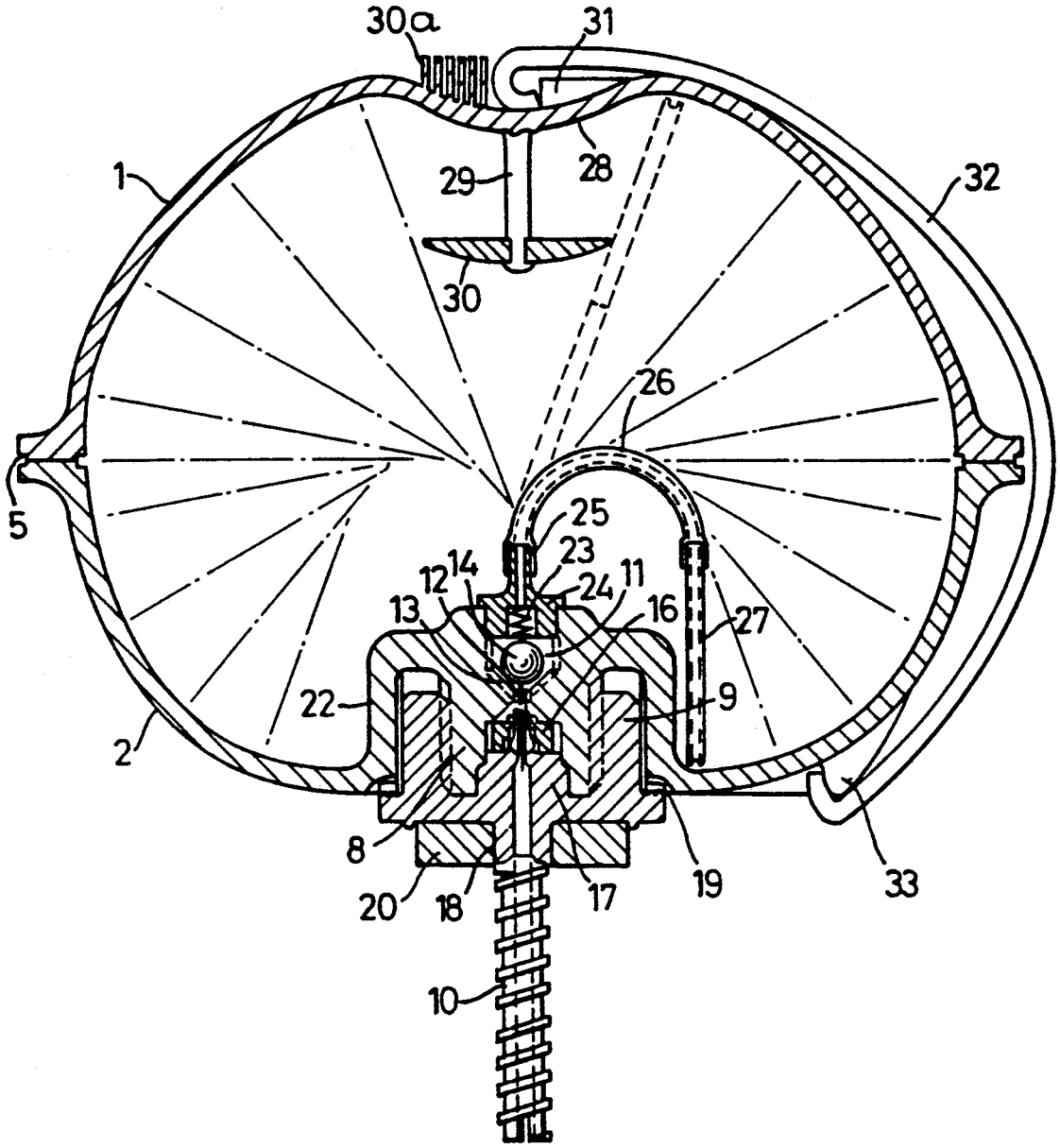
FIG. 2 is a sectional view of another form of injector according to the invention.

Another form of gas-loadable injector is shown in FIG. 2 and for simplicity the same reference numerals are used to identify corresponding parts as in FIG. 1. In FIG. 2 the injector again comprises an accumulator formed of a first shell 1 of flexible plastics and a second shell 2 of a more rigid plastics. The shells 1 and 2 are hot-plate welded together at 5. Again, the shell 2 has an integral boss 8 onto which is screwed a cap and delivery tube member comprising a cap 9 and a delivery tube 10 having a coarse external screw thread. However, unlike FIG. 1, the boss 8 is formed on a re-entrant portion 22 of the shell 2 and the co-operating ratchet teeth 19 are consequently formed differently. In FIG. 2 the flared chamber 11 has a plain flare from the throat 12 and the ball 14 is resiliently urged into contact with the throat 12 by a compression spring 23 seated in an insert 24 screwed into the chamber 11. The frangible seal 16, the nose portion 17, the through-bore 18 and the sealing pad 20 are identical with those in FIG. 1.

The insert 24 has a bored spigot 25 onto which is fitted one end of a flexible and collapsible tube 26. A straight rigid tube 27 has one end fitted into the other end of the tube 26 and the other end of the tube 27 lies at the lowest level within the shells 1 and 2 as shown by various broken lines dependent upon the attitude of the injector.

Directly opposite the re-entrant portion 22 of the shell 2, the shell 1 has a depression 28 from which a stem 29 extends inwardly. A disc 30 is mounted on the inner end of the stem 29 so as to deflect the free end of the tube 27 from contact with the inner side of the depression 28. Within the depression 28 there are provided spines 30*a* and a step 31 for contact with one end of a curved strap-like metal spring 32. Another step 33 for contact with the other end of the spring 32 is provided on the shell 2 near the re-entrant portion 22.

The injector is charged in the following manner. The seal 16, the cap 9 and delivery tube 10, and the spring 32 are removed. The liquid is forced into the shells 1 and 2 under pressure so as to trap and pressurise therein. As the supply of liquid to the shells 1 and 2 is disconnected the ball 14 seats on the throat 12 and retains the liquid under pressure within the shells 1 and 2. A replacement seal 16 is then screwed into place. A frangible plastics washer with a ring pull (not shown) is placed about the cap 9 which is then screwed onto the boss 8 until the washer is clamped between the teeth 19. In this condition, as before, the nose 17 has not pierced the seal 16.

When the charged injector is to be used, the spring 32 is applied as shown and the injector is turned as a whole, while screwing the tube 10 into a pre-bored hole in a timber to be treated, until the sealing pad 20 is hard against the timber. Then the frangible washer is broken and pulled clear so that the cap 9 can be screwed home on the boss 8. In so doing, the nose 17 pierces the seal 16 and dislodges the ball 14 by means of a rod-like projection from the ball 14 extending loosely through the throat 12. This releases the liquid into the timber. While the pressure in the shells 1 and 2 is substantially greater than in the tube 10 the tube 26 is collapsed so that outward flow of liquid is restricted. When the pressure in the shells 1 and 2 is substantially equal to or less than the pressure in the tube 10 the tube 26 opens so as to allow unrestricted flow through the throat 12. Because of this the injector can be recharged with liquid through the tube 10.

It will be noted that although the accumulator in FIG. 2 is not a separated one like in FIG. 1, it can operate in any attitude because of the tubes 26 and 27. Furthermore, the spines 30*a* afford a visual means of indicating exhaustion of the injector since loss of pressure within the shells 1 and 2 causes the spines 30*a* to close together and create a change in appearance.

It is envisaged to provide the liquid for on-site refilling in a portable drum or the like, and to provide filling equipment comprising a small pump having a draw-off cylinder which can be inserted in the filler hole of the drum, a delivery line, a pressure gauge and a coupling piece. For filling large numbers of injectors a "factory fill" system is used.

The invention may be used in impregnating timber with a liquid wood preservative in which case the tube 10 is externally screw-threaded for securing into a pre-bored hole as already described. In order to dry out damp timber and open interstices therein for the reception of the liquid wood preservative, electrically heated probes may be inserted in the pre-bored holes in the timber prior to the application of the injector.

In the case of impregnating brick with a damp-proofing liquid such as silicone the tube 10 may incorporate an expanding collar or the like to provide a mechanical anchor and liquid isolation on pre-bored holes in the bricks. The same could be used in timber.

Where a liquid is required to be injected from a location at predetermined depth in a pre-bored hole the tube 10 may incorporate two expanding collars or the like spaced apart longitudinally of the tube and with the liquid outlet disposed between the collars. Such an arrangement can be used to advantage in a multi-layered hull of a large timber ship.

The liquid injectors described are both designed to impregnate substances exhibiting varying natural rates of liquid uptake. In the case of a substance with a rapid rate of liquid uptake the liquid flow is reduced to the design minimum close to that of the material requirement. However, in the case of a substance with a slow rate of liquid uptake the full discharge pressure is permitted to be employed deep inside the material.

Since the injector is a closed system it can be used under water, or buried in sand etc.

Figure 3:
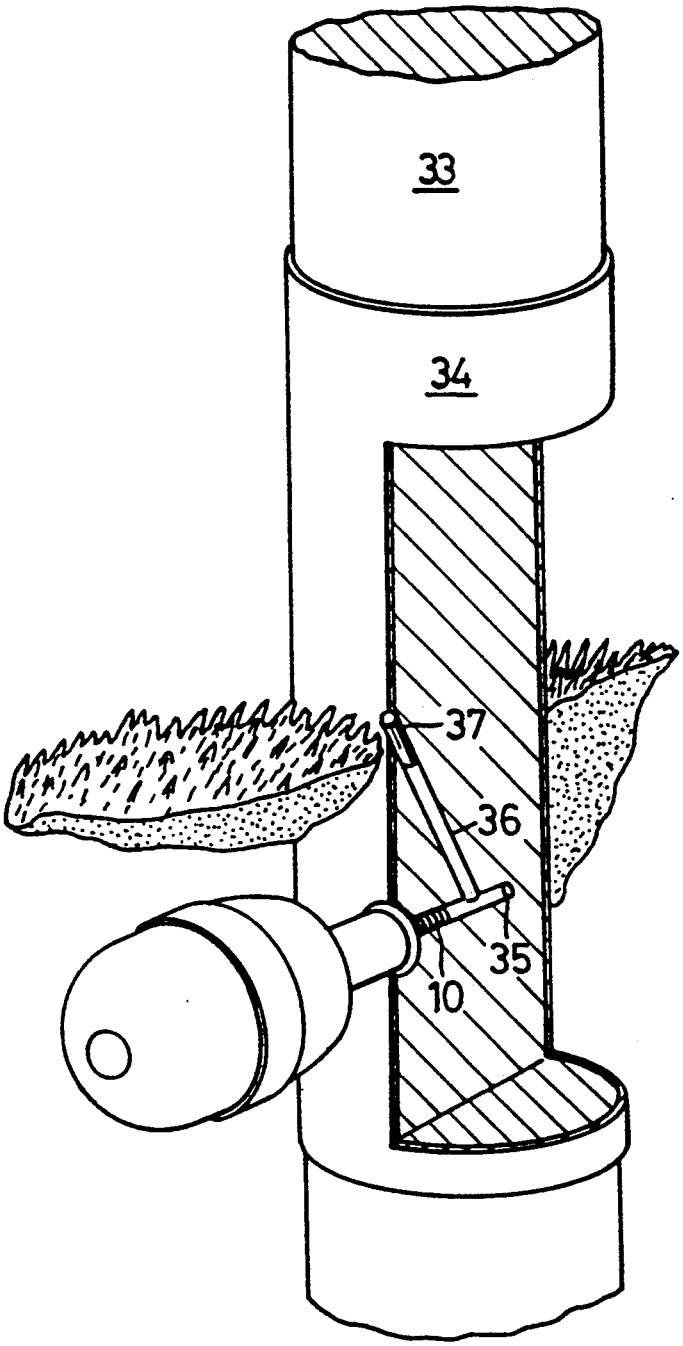
FIG. 3 is a pictorial view, partially broken away, of an injector installed and buried at the base of a timber telegraph pole.

It has already been mentioned that both injectors described can be re-charged via the tube 10. This would be appropriate when the liquid injector is buried or is otherwise inaccessible for refilling with liquid. Such a case exists where the injector is installed at the base of a telegraph pole and buried as shown in FIG. 3 and it becomes necessary after a period to re-impregnate the pole with liquid. At the initial installation of the injector the base of the pole 33 to be buried ultimately, is exposed sufficiently to enable the injector to be buried when fitted. Preferably a protective sheath 34 is applied about the pole at this exposed area extending a short distance above ultimate ground level. A jig (not shown) is applied to the pole and two intersecting holes are bored into the pole, the first hole 35 extending substantially horizontally across the pole a little short of the other side, at a level below ultimate ground level and the second hole 36 being bored in a downwardly inclined direction from a level near to the ultimate ground level. The jig is then removed and the injector is installed as shown with the delivery tube 10 screwed into the hole 35. The hole 36 is closed off with a removable bung 37 and the impregnation is begun. The cavity about the base of the pole is infilled to the ultimate ground level so burying the injector. After a predetermined period of a number of years the hole 36 is reopened and fresh liquid is introduced under pressure from outside so as to backfill and re-pressurise the injector. The fresh liquid then begins to be introduced into the timber at a controlled rate. Finally the bung 37 is replaced in the hole 36. The hole 36 may also serve to receive a diagnostic probe to monitor the efficacy of the protective agent(s) and the internal condition of the timber of the pole from time to time. The probe may be permanently secured to the bung 37.

The hole 35 can be bored completely through the pole so that an injector may be fitted to each end of the hole 35. Where more than two injectors are to be installed there can be bored a plurality of intersecting holes 35. In each case, however, there is only a need for a single hole 36 for back-filling all the injectors and diagnostic purposes.

The injector is designed to inject any liquid which may include nutrients and micro-organisms biologically tailored to protect the timber from bio-degradation and insect attack.

I claim:

1. A method of continued impregnation of a body, comprising the steps of:

(a) providing a gas-loadable liquid injector comprising an accumulator for containing a liquid and a propellant gas, a liquid delivery tube for insertion into a body to be treated by the liquid, and intermediate means between the liquid delivery tube and the accumulator for restricting flow of liquid when the pressure in the accumulator substantially exceeds that in the delivery tube and for allowing unrestricted flow of liquid when the pressure in the accumulator is substantially equal to or less than that in the delivery tube;

(b) setting up a jig on a body;

(c) boring two intersecting holes into the body using the jig, the first hole opening into the body at a position intended to become inaccessible and the second hole opening into the body at a more accessible position;

(d) removing the jig;

(e) installing the injector by inserting the delivery tube into the first hole;

(f) closing off the second hole;

(g) beginning injection of liquid into the body using the injector;

(h) rendering the injector inaccessible;

(i) opening the second hole after a period of time;

(j) back-filling and re-pressurizing the accumulator by introducing fresh liquid under pressure into the second hole from outside; and (k) closing off the second hole so that continued impregnation can take place from the injector.

2. The method of claim 1, wherein said body is a timber pole, and wherein said method further comprises the step of applying a protective sheath about the pole prior to said step (b), said sheath being applied at an area which is exposed sufficiently to enable the injector to be buried after said step (e) and extending a distance above ultimate ground level.

3. A gas-loadable liquid injector comprising:

an accumulator for containing a liquid and a propellant gas, said accumulator having a chamber therein occupied by both the liquid and the gas, and said accumulator including a boss;

a liquid delivery tube for insertion into a material to be treated by the liquid; and intermediate means between said liquid delivery tube and said accumulator for restricting flow of liquid when the pressure in the accumulator substantially exceeds that in said delivery tube and for allowing unrestricted flow of liquid when the pressure in the accumulator is substantially equal to or less than that in said delivery tube, said intermediate means comprising a flexible and collapsible tube extending into said accumulator from said boss and a straight rigid tube have a free end, said free end of said rigid tube always lying at the lowest level in said accumulator regardless of the attitude of said injector so as to dip into any liquid in said accumulator.

4. The liquid injector of claim 3, wherein said accumulator is at least partially deformable; and wherein said injector further comprises an external spring removably fitted to said injector charged with the liquid and gas prior to its use, said spring deforming said accumulator as the pressure therein is reduced; and wherein said accumulator further includes means for visually indicating the change in pressure therein.

5. The liquid injector of claim 3, further comprising:

a replaceable, frangible seal;

a cap configured to screw onto said boss, said cap having a nose configured to pierce said frangible seal when said cap is fully screwed onto said boss, said liquid delivery tube being integral with said cap; and a frangible washer provided between said cap and said boss for limiting the amount by which said cap is screwed onto said boss until said injector is required for use with said frangible seal pierced.

* * * * *